US010743625B2

(12) United States Patent
Bourban et al.

(10) Patent No.: US 10,743,625 B2
(45) Date of Patent: Aug. 18, 2020

(54) METHOD FOR CRIMPING A STONE

(71) Applicant: The Swatch Group Research and Development Ltd, Marin (CH)

(72) Inventors: Stewes Bourban, Chabrey (CH); Pascal Grossenbacher, Neuchatel (CH); Jean-Claude Martin, Montmollin (CH); Vladislav Spassov, Praz (CH); Cecile Barron, Corcelles (CH); Lionel Blaser, Corcelles (CH); Yann Caloz, Pampigny (CH); Cyrille Gernez, Boudry (CH); Stephane Lauper, Cortaillod (CH); Ahmad Odeh, Renens (CH); Simon Springer, Bern (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/140,852

(22) Filed: Sep. 25, 2018

(65) Prior Publication Data

US 2019/0133270 A1 May 9, 2019

(30) Foreign Application Priority Data

Nov. 7, 2017 (EP) ..... 17200360

(51) Int. Cl.
*G04B 47/04* (2006.01)
*A44C 17/04* (2006.01)
(Continued)

(52) U.S. Cl.
CPC ..... *A44C 17/04* (2013.01); *A44C 27/00* (2013.01); *C25D 1/003* (2013.01); *C25D 5/022* (2013.01); *C25D 7/005* (2013.01); *G04B 47/042* (2013.01)

(58) Field of Classification Search
CPC ..... A44C 17/04; A44C 27/00; G04B 47/042; C25D 5/022; C25D 1/003; C25D 7/005
See application file for complete search history.

(56) References Cited

U.S. PATENT DOCUMENTS 6,499,314 B1 * 12/2002 Weinmann ..... A44C 17/0216 63/26
6,668,584 B1 * 12/2003 Tosti ..... A44C 17/02 63/26

(Continued)

FOREIGN PATENT DOCUMENTS

EP 0 620 987 A1 10/1994
JP 6-240487 8/1994

OTHER PUBLICATIONS

European Search Report dated Mar. 8, 2018 in European Application 17200360.0, filed on Nov. 7, 2017 (with English Translation of Categories of cited documents).

*Primary Examiner* — Rick K Chang
(74) *Attorney, Agent, or Firm* — Oblon, McClelland, Maier & Neustadt, L.L.P.

(57) ABSTRACT

A method for assembling a stone on a setting support, the stone being cut to exhibit a table, a crown, a girdle and a pavilion. A substrate with a recess for the stone, the recess forming, between the substrate and the stone, a peripheral free space in the vicinity of the girdle and of the zones of the crown and of the pavilion contiguous to the girdle, the peripheral free space including a bottom having a conductive surface. Electroplating, in the peripheral free space, a metal layer in the vicinity of the girdle and of the zones of the crown and of the pavilion contiguous to the girdle, so as to confine the girdle in the metal layer to form, around the girdle, the setting support. The stone and its setting support are released from the substrate.

15 Claims, 2 Drawing Sheets

(51) Int. Cl.

| | |
|---|---|
| ***C25D 7/00*** | (2006.01) |
| ***C25D 1/00*** | (2006.01) |
| ***C25D 5/02*** | (2006.01) |
| ***A44C 27/00*** | (2006.01) |

(56) References Cited

U.S. PATENT DOCUMENTS

| | | | | |
|---|---|---|---|---|
| 7,140,199 | B2 * | 11/2006 | Behr | A44C 17/04 63/27 |
| 7,596,967 | B2 * | 10/2009 | Ostfeld | A44C 17/04 63/26 |
| 7,691,221 | B2 * | 4/2010 | Swarovski | A44C 17/04 156/250 |
| 7,971,326 | B2 * | 7/2011 | Apprederisse | A44C 17/04 29/10 |
| 8,215,126 | B2 * | 7/2012 | Mattar | A44C 17/005 63/26 |
| 8,789,251 | B2 * | 7/2014 | Labow | A44C 17/02 29/10 |
| 9,084,457 | B2 * | 7/2015 | Rizzo | A44C 17/02 |
| 9,204,693 | B2 * | 12/2015 | Sunne | A44C 17/02 |
| 9,345,294 | B2 * | 5/2016 | Grossenbacher | A44C 17/005 |
| 9,462,859 | B2 * | 10/2016 | Disinger | A44C 15/0015 |
| 9,820,538 | B2 * | 11/2017 | Lebreton | G04B 47/042 |
| 10,206,464 | B2 * | 2/2019 | Lauper | A44C 17/04 |
| 10,405,619 | B2 * | 9/2019 | Dubach | A44C 27/001 |
| 2007/0266732 | A1 * | 11/2007 | Osifeld | A44C 17/006 63/32 |
| 2008/0066310 | A1 * | 3/2008 | Pang | A44C 17/04 29/896.4 |
| 2008/0156426 | A1 * | 7/2008 | Swarovski | A44C 17/04 156/256 |
| 2010/0017944 | A1 * | 1/2010 | Hirschmann | A44C 17/04 2/244 |
| 2012/0304890 | A1 * | 12/2012 | Rizzo | A44C 17/04 106/286.8 |
| 2019/0271951 | A1 * | 9/2019 | Bonke | G04B 39/00 |

* cited by examiner

METHOD FOR CRIMPING A STONE

This application claims priority from European Patent Application No. 17200360.0 filed on Nov. 7, 2017; the entire disclosure of which is incorporated herein by reference.

FIELD OF THE INVENTION

The invention relates to a method for assembling a stone on a setting support, said stone being cut to exhibit a table, a crown, a girdle and a pavilion. The invention also relates to a method for crimping, on an element of a timekeeping or jewelry part, a stone and its setting support obtained according to said assembly method.

BACKGROUND OF THE INVENTION

It is known that precious, semi-precious or synthetic stones can be crimped using claws, grains or rails. Conventional crimping by assembling a natural stone, such as diamond or emerald, in a setting by means of claws generally requires dimensional control of close to 5/100 of the size of the stones. For this reason, this type of crimping is not compatible with that of mass produced, low-cost crimped stones, for their part using stones with greater precision, of close to 1/100, such as synthetic diamond, zircon and ruby.

SUMMARY OF THE INVENTION

The aim of the present invention is to overcome this disadvantage by proposing a method for crimping stones allowing the inevitable dimensional variations to be overcome that are encountered when natural stones, such as diamonds or emeralds, are used.

To this end, the invention first and foremost relates to a method for assembling a stone on a setting support, said stone being cut to exhibit a table, a crown, a girdle and a pavilion, said method comprising the following steps:

a) providing a substrate comprising at least one recess, in which said stone is positioned, said recess being arranged to form, between the substrate and said stone, a peripheral free space at least in the vicinity of the girdle of the stone and of the zones of the crown and of the pavilion contiguous to the girdle, the bottom of said peripheral free space having a conductive surface;

b) depositing, by electroplating in said peripheral free space, a metal layer at least in the vicinity of the girdle and of the zones of the crown and of the pavilion contiguous to the girdle, so as to confine said girdle in said metal layer to form, at least substantially around the girdle of the stone, said setting support;

c) releasing said stone and its setting support from the substrate.

In a particularly advantageous manner, the substrate and its recess can be produced according to the following steps:

d) providing a substrate having a conductive surface layer and producing at least one through-hole in said substrate;

e) covering the substrate with a photosensitive resin layer and forming, by photolithography in the photosensitive resin, a cavity, the dimensions of which, in the plane of the substrate, are greater than the dimensions of the girdle of the stone, so that the cavity comprises a central opening corresponding to the through-hole and a peripheral zone comprising resin side walls and a bottom occupied by the conductive layer of the substrate around the through-hole, the dimensions of the cavity and of the through-hole forming the recess being selected so that the pavilion of the stone is partially housed in the through-hole, so as to rest on the periphery of the central opening of the cavity, the remainder of the pavilion above the through-hole defining the zone of the pavilion contiguous to the girdle, and so that the remainder of the stone between said zone of the pavilion contiguous to the girdle and at least up to the level of the zone of the crown contiguous to the girdle is housed in the cavity, so as to form, between the stone and the walls of the cavity, said peripheral free space.

The method according to the invention allows the dimensions of the recess and, more specifically, the dimensions of the through-hole to be selected, so as to adapt to the dimensional variations of the stones.

The invention also relates to a method for crimping a stone on an element of a timekeeping or jewelry part comprising the assembly, on a setting subsequently added to the element of a timekeeping or jewelry part or directly on the element of a timekeeping or jewelry part, of the stone and of its setting support obtained according to the method as defined above.

The invention also relates to an element of a timekeeping or jewelry part comprising at least one stone assembled on its setting support obtained according to the assembly method as defined above.

BRIEF DESCRIPTION OF THE DRAWINGS

Further features and advantages will become clearly apparent from the description, which is provided hereafter by way of a non-limiting example, with reference to the accompanying drawings, in which.

DETAILED DESCRIPTION OF PREFERRED EMBODIMENTS

Figure 1:
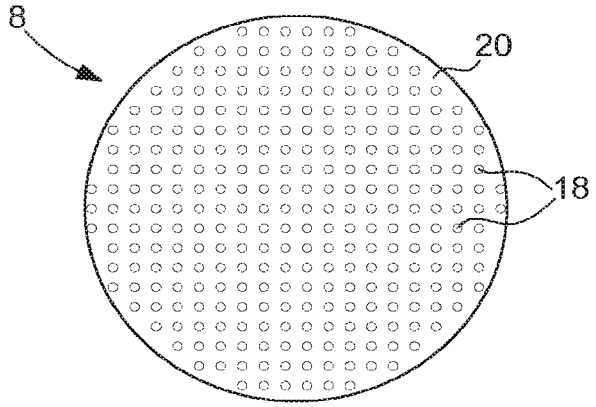
FIGS. 1 to 6 are representations of the successive steps of a method for assembling a stone on a setting support according to the invention.

With reference to FIGS. 1 to 6 and 8, the present invention relates to a method for assembling a stone 1 on a setting support 2, said stone 1 being cut to exhibit a table 3, a crown 4, a girdle 5 and a pavilion 6. Such a stone preferably is a natural stone, such as diamond or emerald, the dimensions of which can vary from one stone to the next. It is obvious that the stone can be of any other type, natural or synthetic, the method according to the invention also advantageously being able to be used for such stones.

The first step a) of the method for assembling the stone 1 on a setting support 2 according to the invention involves providing a substrate 8 comprising at least one recess 10, in which said stone 1 is positioned, said recess 10 being arranged to form, between the substrate 8 and said stone 1, a peripheral free space 12 at least around the girdle 5 of the stone 1, the bottom 14 of said peripheral free space 12 having a conductive surface 16. "Around the girdle" means that the peripheral free space 12 is positioned at least in the vicinity of the girdle 5 and of zones 4*a* and 6*a* of the crown 4 and of the pavilion 6 respectively contiguous to the girdle 5.

More specifically, the substrate 8 and its recess 10 advantageously can be produced according to the following steps, d) and e):

Step d) involves providing a substrate 8 having a conductive surface layer 16 and producing at least one through-hole 18 in said substrate 8. One through-hole 18 is formed per stone 1 to be assembled. Advantageously, the substrate 8 is, for example, based on silicon, glass, ceramic or quartz. Silicon wafers for microelectronics can be used, for example. The conductive layer 16 can be obtained by PVD (Physical Vapour Deposition) of chrome, titanium, gold and the combinations thereof, for example. Any other suitable conductive layer can be used. The through-holes 18 can be formed on the substrate 8 by laser ablation, for example. Advantageously, the distribution of the through-holes 18 on the surface of the substrate is particularly optimised as a function of the dimensions of the recesses, the shape of the setting supports, etc., so as to have a maximum number of through-holes on the surface of the substrate 8.

Step e) involves covering the substrate 8 with a photosensitive resin layer 20, as shown in FIG. 1, then forming, by photolithography in said photosensitive resin 20, a cavity 22, said cavity 22 and the through-hole 18 forming the recess 10, in which the stone 1 will be positioned, as will be described hereafter. The cavity 22 is hollowed out until the conductive layer 16 appears.

Figure 2:
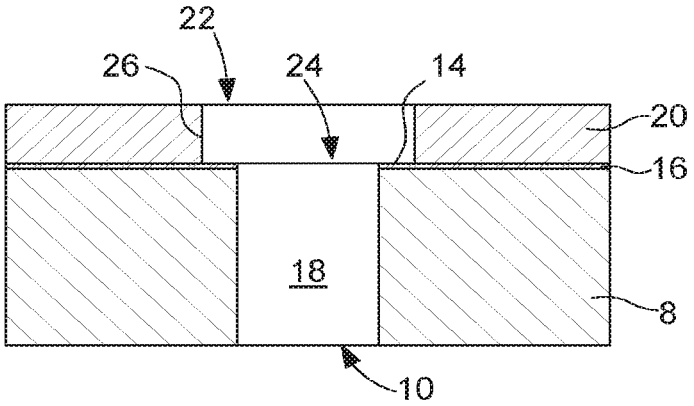

The dimensions of the through-hole 18, in the plane of the substrate 8, are less than the dimensions (generally called "diameter") of the girdle 5 of the stone 1, and the dimensions of the cavity 22, in the plane of the substrate 8, are greater than the diameter of the girdle 5 of the stone 1. Consequently, the dimensions of the cavity 22, in the plane of the substrate 8, are greater than the dimensions of the through-hole 18, the cavity 22 then comprising a central opening 24 corresponding to the through-hole 18, and a peripheral zone comprising resin side walls 26 and a bottom, i.e. the bottom 14 occupied by the conductive layer 16 of the substrate 8 around the through-hole 18. The recess 10 therefore has a T-shaped section in the plane perpendicular to the substrate 8, as shown in FIG. 2.

In a particularly advantageous manner, step e) comprises the use of a negative photosensitive resin 20, for example, an SU8 resin, with the UV irradiation of the photosensitive resin layer 20 through a mask corresponding to the profile of the desired setting support, and the removal of the non-irradiated part of the photosensitive resin layer 20, so as to obtain the cavity 22, the profile of which corresponds to the profile of said desired setting support. Such a photolithography method is per se known to a person skilled in the art and does not require a more detailed description.

Once the substrate 8 and its recesses 10 are produced, step a) of the assembly method according to the invention progresses to the installation of a stone 1 in each of the formed recesses 10.

The dimensions of the cavity 22 and of the through-hole 18 forming the recess 10 are selected so that the pavilion 6 of the stone 1 is partially housed in the through-hole 18, in order to rest on the periphery of the central opening 24 of the cavity 22, with the remainder of the pavilion 6 above the through-hole 18 defining the zone 6*a* of the pavilion 6 contiguous to the girdle 5, and so that the remainder of the stone 1 between said zone 6*a* of the pavilion 6 contiguous to the girdle 5 and at least up to the level of the zone 4*a* of the crown 4 contiguous to the girdle 5 is housed in the cavity 22, so as to form, between the stone 1 and the walls of the cavity 22, i.e. the side walls 26 and the bottom 14, said peripheral free space 12.

Figure 3:
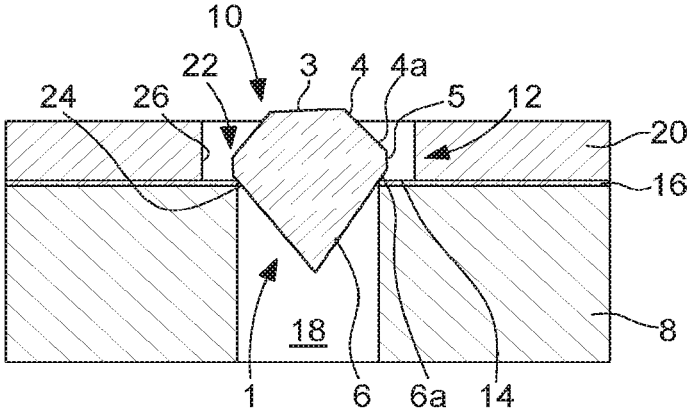
Figure 4:
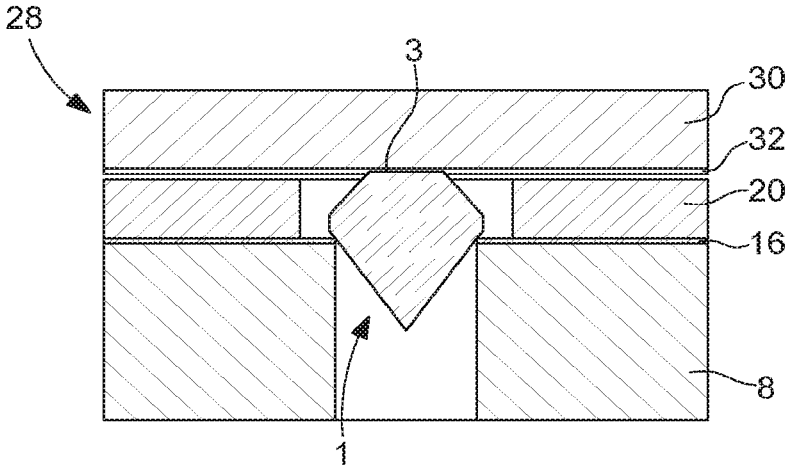
Figure 5:
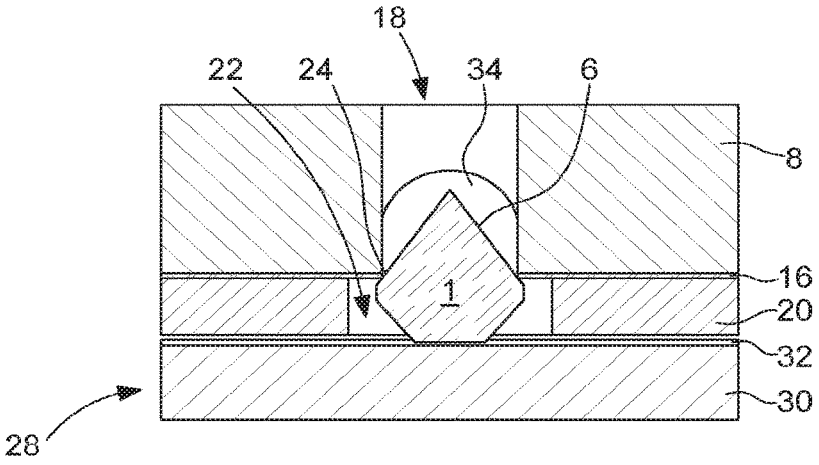

In a particularly preferred manner, the dimensions of the cavity 22 and of the through-hole 18 are selected so that the pavilion 6 of the stone 1 is practically fully housed in the through-hole 18, so that the zone 6*a* of the pavilion 6 contiguous to the girdle 5 only extends directly below the girdle 5, and the zone 4*a* of the crown 4 contiguous to the girdle 5 only extends directly above the girdle 5, so as to form, between the stone 1 and the walls of the cavity 22, i.e. the side walls 26 and the bottom 14, said peripheral free space 12 only substantially around the girdle 5, i.e. in the vicinity of the girdle 5 and only directly on either side of said girdle 5, as shown in FIG. 3. Furthermore, the height of the recess 10, and more specifically of the cavity 22, is such that the table 3 of the stone 1 exceeds said recess 10, and more specifically the cavity 22, as shown in FIG. 3. The thickness of the resin layer 20 is selected to this end.

Since the only precise dimension of the stone that can be provided is the "diameter" of the girdle 5 and its height, it is possible that the stone 1 is not installed correctly and does not ensure that sufficient flatness is provided for the table 3 of the stone 1.

In this case, the assembly method according to the invention can comprise, between steps a) and b), a step f) of correcting the orientation of the stone. Advantageously, and with reference to FIG. 4, this step f) can comprise bringing the table 3 of the stone 1 into contact with a repositioning device 28 arranged to reposition the stone 1 in its recess 10. Such a repositioning device 28 comprises, for example, a rigid plate 30 covered with a deformable sheet or a foam 32 allowing the heights of the stones 1 to be compensated. The repositioning device 28 is arranged so that the sheet or the foam 32 is brought into contact with the tables 3 of the stones positioned in their respective recesses 10 on the substrate 8, so as to correct the orientation of said stones and to provide the flatness of the tables 3 of the stones 1.

Before removing the repositioning device 28, it may be necessary to provide, between steps f) and b), a step g) of setting the pavilion 6 of the stone 1 in the through-hole 18. This step g) allows the correct positioning of the stones 1 to be maintained in their recesses 10, even after the repositioning device 28 has been removed.

Step g) involves, for example, introducing, through the open inlet of the through-hole 18, a retention adhesive 34 around the pavilion 6 of the stone 1, allowing the stone 1 to be set in the recess 10. In order to prevent the retention adhesive 34 from entering the cavity 22 if there is a clearance between the stone 1 and the central opening 24, a sufficiently viscous retention adhesive can be used that will not fill the narrowest gaps. It is also possible to plug, on the side of the cavity 22, any gaps existing between the stone 1 and the central opening 24, prior to depositing the retention adhesive 34. To this end, a resin can be sprayed into said gaps, on the side of the cavity 22, which resin can be easily removed (by dissolution, for example). Provision also can be made to deposit an indium layer of approximately 50 μm on the silicon substrate 8 before installing the stones 1. The indium layer has the advantage of deforming during the step f) of correcting the orientation of the stones by levelling the tables 3 and subsequently being able to provide the seal in the vicinity of the central opening 24 of the cavity 22.

Step g) is followed by a step h) of removing the repositioning device 28 in order to be able to continue the implementation of the assembly method of the invention.

Figure 6:
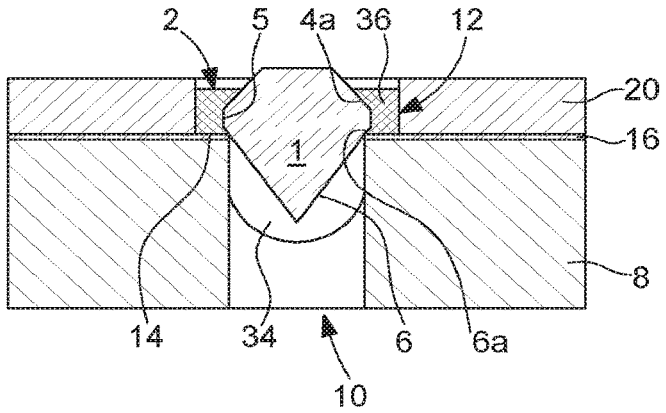

Once the stone 1 is positioned in its recess 10 on the substrate 8 by forming, between said substrate 8 and said stone 1, a peripheral free space 12 at least in the vicinity of the girdle 5 and of the zones 4*a* and 6*a*, respectively of the crown 4 and of the pavilion 6 contiguous to the girdle 5 according to step a) described above, the assembly method according to the invention progresses with the implementation of step b). This step b) involves depositing, by electroplating in said peripheral free space 12, from the bottom 14 of said peripheral free space 12 occupied by the conductive layer 16, a metal layer 36 in the vicinity of the girdle 5 and of the zones 4*a*, 6*a*, respectively of the crown 4 and of the pavilion 6 contiguous to the girdle 5, so as to confine said girdle 5 in said metal layer 36 in order to form, at least substantially around the girdle 5 of the stone 1, said setting support 2, as shown in FIG. 6. With its girdle 5 being confined in the metal layer 36 forming the setting support 2, the stone 1 is now rigidly connected to its setting support 2.

The metal layer 36 deposited in step b) preferably is made of a material selected from the group comprising nickel, gold, silver, platinum, rhodium, palladium, copper and the alloys thereof.

The electroforming conditions, particularly the composition of the baths, the geometry of the system, the voltages and current densities, are selected for each metal or alloy to be electro-deposited according to the techniques that are well known in the art of electro-forming (cf., for example, Di Bari G. A., "Electroforming" Electroplating Engineering Handbook, 4th Edition, compiled by L. J. Durney, published by Van Nostrand Reinhold Company Inc., N.Y. USA 1984).

The sizes of the setting support 2 are defined by the dimensions, in the plane of the substrate 8, of the through-hole 18 and of the cavity 22, and by the height of the metal layer 36 deposited according to the electroplating parameters.

Figure 8:
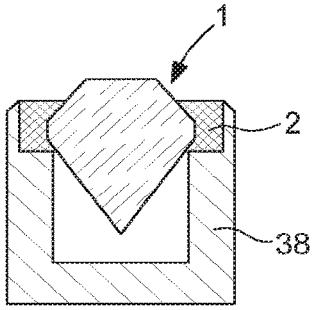
FIG. 8 is a section view showing a stone and its setting support mounted on a setting.

Preferably, these parameters are selected so that the metal layer 36 is deposited only substantially in the vicinity of the girdle 5 and of the zones 4*a*, 6*a*, respectively of the crown 4 and of the pavilion 6 that only extend directly on either side of the girdle 5, so that the setting support 2 is positioned substantially around the girdle 5 only, as shown in FIG. 8. The setting support 2 slightly exceeds the zones 4*a* and 6*a*, respectively of the crown 4 and of the pavilion 6 contiguous to the girdle 5, but the essence of the crown 4 and of the pavilion 6 remains free.

The following step c) involves releasing the stone 1 assembled on its setting support 2 from the substrate 8. To this end, the silicon substrate 8 and the retention adhesive 34 are removed by dissolution. For example, 20% potassium hydroxide KOH can be used that is heated to 85° C. to dissolve the silicon and commercial solvents can be used to dissolve the adhesive.

The assembly method according to the invention enables adaptation to the dimensional variations of the stones 1 by providing, in the substrate 8, through-holes 18 with various diameters, adapted to the dimensions of said stones 1.

Figure 7A:
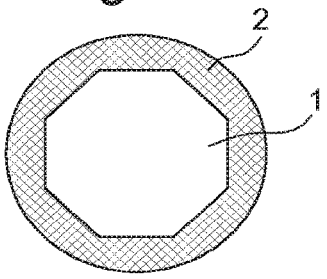
FIGS. 7*a* to 7*c* are top views of various variations of stones and of setting supports obtained according to the method of the invention.
Figure 7B:
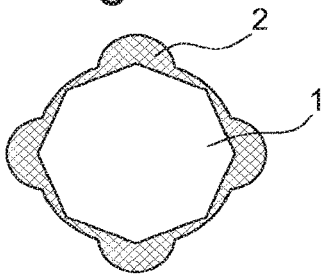
Figure 7C:
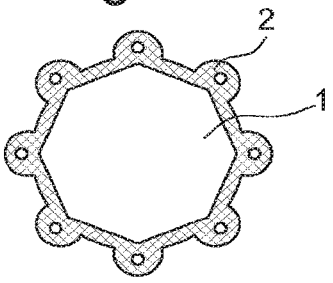

FIGS. 7*a* to 7*c* show some variations of stones 1 assembled on their setting support 2, which variations can be obtained by using various photolithographic exposure masks corresponding to the profile of the desired setting support.

The stone 1, assembled on its setting support 2, that is thus released can be used in the crimping method according to the invention.

Said method for crimping said stone on an element of a timekeeping or jewelry part comprises assembling the stone 1 and its setting support 2, obtained according to the assembly method as described above, on a setting 38, as shown in FIG. 8. The setting 38 is then added to the element of a timekeeping or jewelry part.

In another variation, the stone 1 and its setting support 2, obtained according to the assembly method as described above, are directly mounted on the element of a timekeeping or jewelry part.

The assembly of the setting support 2 bearing the stone 1 on the setting 38 or directly on the element of a timekeeping or jewelry part can be carried out by clipping, pressing, crimping, gluing, etc.

The element of a timekeeping or jewelry part can be, for example, a dial, a bevel, a rotary bevel, a middle, a horn of the case, a crown, a hand, an index, a link or other bracelet element, a pendant element, a ring, a collar, etc., or any timekeeping/jewellery decorative element that can be crimped.

What is claimed is:

1. A method for assembling a stone on a setting support, said stone being cut to exhibit a table, a crown, a girdle and a pavilion, the assembly method comprising the following steps:

a) providing a substrate comprising at least one recess and then positioning said stone in said recess, said recess being arranged to form, between the substrate and said stone, a peripheral free space at least in a vicinity of the girdle and of zones of the crown and of the pavilion contiguous to the girdle, said peripheral free space comprising a bottom having a conductive surface;

b) depositing, by electroplating in said peripheral free space, a metal layer at least in the vicinity of the girdle and of the zones of the crown and of the pavilion contiguous to the girdle, so as to confine said girdle in said metal layer to form said setting support;

c) releasing said stone and its setting support from the substrate, wherein the substrate and its recess are produced according to the following steps:

d) providing the substrate having a conductive surface layer and producing at least one through-hole in said substrate;

e) covering the substrate with a photosensitive resin layer and forming, by photolithography in the photosensitive resin, a cavity, the dimensions of which, in a plane of the substrate are greater than the dimensions of the girdle of the stone, so that the cavity comprises a central opening corresponding to the through-hole and a peripheral zone comprising resin side walls and a bottom occupied by the conductive layer of the substrate around the through-hole, the dimensions of the cavity and of the through-hole forming said recess being selected so that the pavilion of the stone is partially housed in the through-hole, so as to rest on the periphery of the central opening of the cavity, a remainder of the pavilion above the through-hole defining the zone of the pavilion contiguous to the girdle, and so that a remainder of the stone between said zone of the pavilion contiguous to the girdle and at least up to a level of the zone of the crown contiguous to the girdle is housed in the cavity, so as to form, between the stone and the walls of the cavity, said peripheral free space.

2. The method according to claim 1, wherein the dimensions of the cavity and of the through-hole are selected so that the pavilion of the stone is practically fully housed in the through-hole, so that the zone of the pavilion contiguous to the girdle only extends directly below the girdle, and the zone of the crown contiguous to the girdle only extends directly above the girdle, so as to form, between the stone and the walls of the cavity, substantially in the vicinity of the girdle and of said zones of the crown and of the pavilion contiguous to the girdle, said peripheral free space.

3. The method according to claim 1, wherein the height of the recess is such that the table of the stone exceeds said recess.

4. The method according to claim 3, further comprising, between steps a) and b), a step f of correcting the orientation of the stone.

5. The method according to claim 4, wherein step f) comprises bringing the table of the stone into contact with a repositioning device for repositioning the stone in its recess.

6. The method according to claim 5, wherein it comprises further comprising, between steps f and b), a step g) of setting the pavilion of the stone in the through-hole.

7. The method according to claim 6, wherein step g) is followed by a step h) of removing the repositioning device.

8. The method according to claim 5, wherein the repositioning device includes a rigid plate covered with a deformable sheet or foam.

9. The method according to claim 6, wherein step g) includes introducing, though an open inlet of the through-hole, a retention adhesive around the pavilion of the stone.

10. The method according to claim 1, wherein the metal layer deposited during step b) is made of a material selected from the group consisted of nickel, gold, silver, platinum, rhodium, palladium, copper and the alloys thereof.

11. The method according to claim 1, wherein step e) comprises the use of a negative photosensitive resin, with UV irradiation of the photosensitive resin layer through a mask corresponding to a profile of the setting support, and removal of a non-irradiated part of the photosensitive resin layer, so as to obtain said cavity, a profile of which corresponds to the profile of the setting support.

12. The method according to claim 1, wherein the substrate is based on a material selected from the group consisted of silicon, a ceramic, a glass and a quartz.

13. The method according to claim 1, wherein the through-hole is produced in said substrate by laser ablation.

14. The method according to claim 1, wherein the releasing includes removing the substrate by dissolution.

15. A method for crimping a stone on an element of a timekeeping or jewelry part, comprising:

assembling a stone on a setting support, said stone being cut to exhibit a table, a crown, a girdle and a pavilion, the assembling the stone on the setting support comprising the following steps:

a) providing a substrate comprising at least one recess and then positioning said stone in said recess, said recess being arranged to form, between the substrate and said stone, a peripheral free space at least in a vicinity of the girdle and of zones of the crown and of the pavilion contiguous to the girdle, said peripheral free space comprising a bottom having a conductive surface;

b) depositing, by electroplating in said peripheral free space, a metal layer at least in the vicinity of the girdle and of the zones of the crown and of the pavilion contiguous to the girdle, so as to confine said girdle in said metal layer to form said setting support;

c) releasing said stone and its setting support from the substrate, wherein the substrate and its recess are produced according to the following steps:

d) providing the substrate having a conductive surface layer and producing at least one through-hole in said substrate;

e) covering the substrate with a photosensitive resin layer and forming, by photolithography in the photosensitive resin, a cavity, the dimensions of which, in a plane of the substrate, are greater than the dimensions of the girdle of the stone, so that the cavity comprises a central opening corresponding to the through-hole and a peripheral zone comprising resin side walls and a bottom occupied by the conductive layer of the substrate around the through-hole, the dimensions of the cavity and of the through-hole forming said recess being selected so that the pavilion of the stone is partially housed in the through-hole, so as to rest on the periphery of the central opening of the cavity, a remainder of the pavilion above the through-hole defining the zone of the pavilion contiguous to the girdle, and so that a remainder of the stone between said zone of the pavilion contiguous to the girdle and at least up to a level of the zone of the crown contiguous to the girdle is housed in the cavity, so as to form, between the stone and the walls of the cavity, said peripheral free space and assembling the stone and the setting support on a setting added to the element of a timekeeping or jewelry part or directly on the element of a timekeeping or jewelry part.

* * * * *